United States Patent [19]

Gedeon

[11] 4,266,337

[45] May 12, 1981

[54] ELECTRIC HEATING ELEMENTS

[75] Inventor: George C. Gedeon, Pittsburgh, Pa.

[73] Assignee: Emerson Electric Co., St. Louis, Mo.

[21] Appl. No.: 56,554

[22] Filed: Jul. 11, 1979

[51] Int. Cl.[3] ..... H01C 17/00; B21B 37/02

[52] U.S. Cl. ..... 29/614; 72/12; 72/16; 72/17

[58] Field of Search ..... 72/17, 16, 14, 199, 72/234, 9–12; 29/615, 614

[56] References Cited

U.S. PATENT DOCUMENTS

| | | | |
|---|---|---|---|
| Re. 25,075 | 10/1961 | Hessenberg | 72/9 |
| 2,332,797 | 10/1943 | Hume | 72/10 |
| 3,000,243 | 9/1961 | Stringer | 72/16 |
| 3,007,235 | 11/1961 | Yoke | 29/614 |
| 3,807,207 | 4/1974 | Obdrzalek | 72/12 |

*Primary Examiner*—Milton S. Mehr

*Attorney, Agent, or Firm*—Michael Williams

[57] ABSTRACT

The present invention is for the purpose of measuring the increase in growth or length of a sheathed heating element as it is reduced in transverse size to compact the refractory material therein, and feeding the growth to a logic control unit which is preset by an operator to obtain the desired final target length of the element within acceptable limits. The logic control unit, by computation, automatically subtracts the growth length from a preset length growth reference and makes the necessary additional computations that will send the proper signal to a motor control unit. The motor control unit translates the signal fed to it and in turn sends a signal to operate stepper motors, the latter controlling the bight between final compression rolls to compress the element just enough to elongate it within the target length range.

9 Claims, 4 Drawing Figures

ELECTRIC HEATING ELEMENTS

BACKGROUND AND SUMMARY

The normal tubular heating element comprises a rectilinear metal sheath, usually round in cross section, and having a helically-coiled resistance wire within the sheath and held centered within the sheath by powdered refractory material. Terminal pins are connected to opposite ends of the resistor coil and extend outwardly of opposite ends of the sheath. Dielectric plugs surround the terminal pins at the sheath ends to contain the refractory material. U.S. Pat. No. 2,272,282, issued to E. L. Wiegand, illustrates a tubular heater of the general type referred to.

In normal manufacture, the tubular element above described is subjected to a rolling operation to reduce the diameter thereof and thus compress and densify the refractory material to a rock-like hardness. The rolling operation increases the length of the tubular element as the diameter of the tubular unit is reduced and the present invention is for the purpose of automatically measuring the growth of a sample length of the tubular element and for automatically making machine adjustments to hold the growth of the entire element within acceptable limits. In another aspect of the invention the full length of the tubular element is subjected to a measuring operation so that the full growth is measured.

In the manufacture of well-known surface units, a tubular element, after rolling, is put into a spiralling machine to provide a finished unit having a flat intermediate spiralled portion and a pair of terminal portions extending from opposite ends of the spiralled portion. A typical surface unit is shown in U.S. Pat. No. 3,350,674, issued to L. S. Kozbelt and D. M. Cunningham.

It is important that the final length of a rolled tubular element be held within certain tolerances, since if the rolled element is too long or too short, the terminal portions of the spiralled surface unit will be too long or too short or uneven in length and this causes problems, especially in a surface unit of the plug-in type. If the rolled element is too short, the spiralled unit cannot be used for plug-in purposes and most likely would be scrapped. If the rolled element is too long, the longer terminal portions may be trimmed to proper length, but this represents additional labor. If the terminal portions are uneven in length, with the shorter one within acceptable limits, the longer one may be trimmed but again this requires additional labor. The present invention provides for measuring a sample length of a tubular unit (or the full length) after having been reduced in the reducing rolls during the rolling operation, and utilizing the measurement in length growth to effect means for holding the tubular unit within prescribed tolerances.

DESCRIPTION OF THE DRAWINGS

In the drawings accompanying this specification and forming a part of this application there are shown, for purpose of illustration, embodiments which my invention may assume, and in these drawings.

DESCRIPTION OF THE PREFERRED EMBODIMENT

Figure 1:
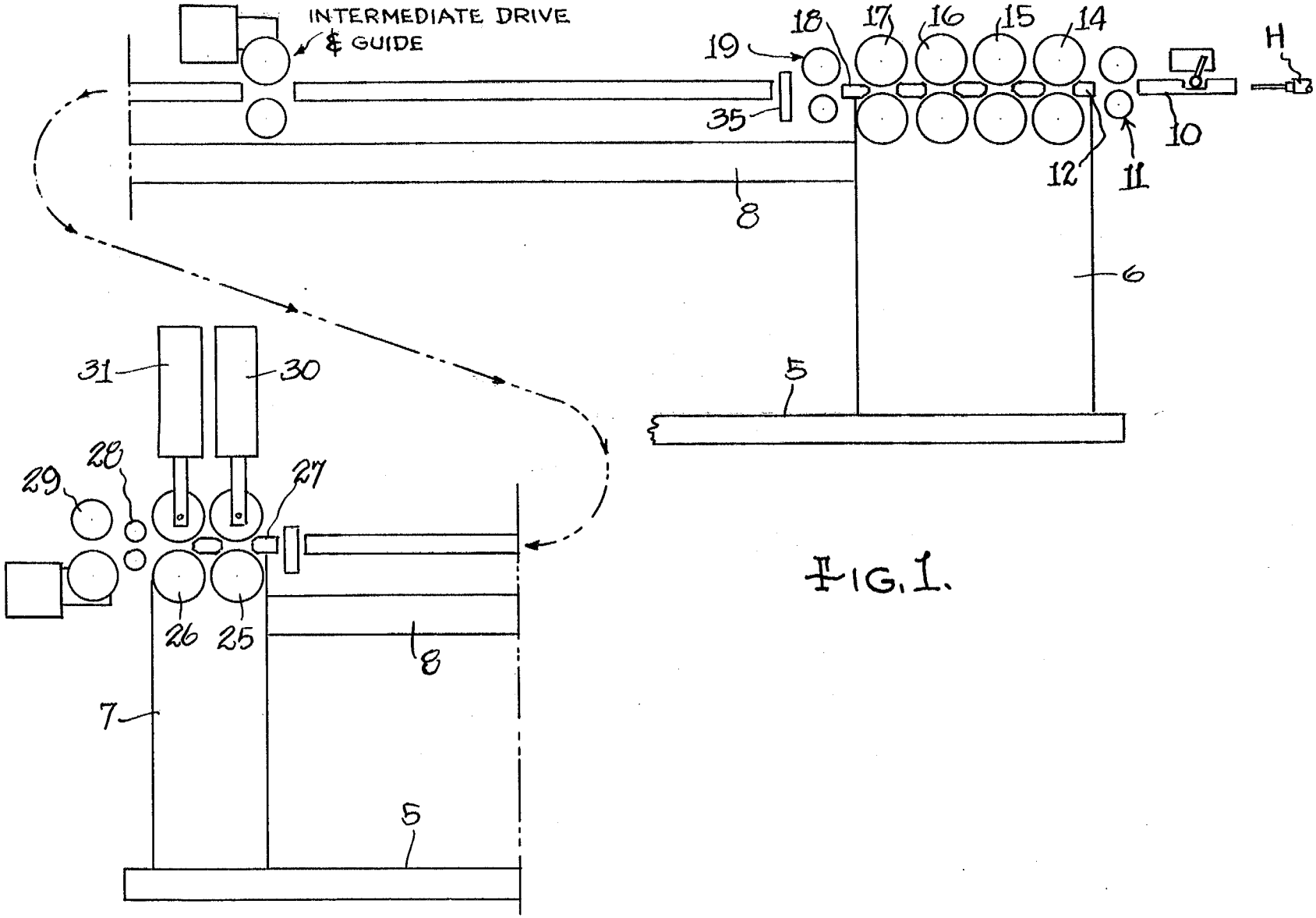
FIG. 1 is a generally schematic side elevational view of a machine for determining growth of a tubular element during a rolling operation and for holding such growth within predetermined tolerances.

The apparatus for measuring the growth of a rolled tubular heating element, and translating the measurement to means for controlling the growth to predetermined tolerances, is supported on a base 5. A pair of spaced stands 6 and 7 are fixed to and extend upwardly from the base, and a crossmember 8 is secured between the stands.

The heating element H whose length is to be controlled is inserted into a tubular guide 10 which is fixedly carried by the stand 6, and from the guide into the bight of a first set of measuring rolls 11 which are rotated by the sheath as it moves therebetween to thereby translate linear motion of the sheath to corresponding rotation of the rolls 11.

From the rolls 11 the sheath passes through a tubular guide 12 to a series of compression rolls, four of which are herein disclosed, numbered 14, 15, 16 and 17, with tubular guides therebetween. The compression rolls sucessively work the metal sheath to reduce its diameter. From the roll 17, the sheath passes through a tubular guide 18 and into the bight of a second set of measuring rolls 19. The rolls 19, like the rolls 11, translate linear motion of the sheath to corresponding rotation of the rolls.

Between the sets of rolls 11 and 19, the sheath has increased in length, due to the elongation caused by the diameter reduction of the sheath by the working of the compression rolls 14–17. Therefore, a greater length of sheath will pass through the rolls 19 and accordingly cause these rolls to rotate a greater amount than the rolls 11, and the difference in rotation is utilized to actuate mechanism for holding the growth of the tubular element within predetermined tolerances.

Normally, the compression rolls 14–17 are set to reduce the diameter of the sheath an amount less than the final amount, so that the growth of the sheath is less than the final growth. Further compression rolls are carried by the stand 7 to finally work the sheath and, in the embodiment disclosed, two sets of compression rolls 25 and 26 are provided. The sheath passes through a fixed tubular guide 27 and into the bight of the roll set 25, and from there passes through another fixed guide to the bight of the roll set 26. From the roll set 26, the sheath passes through a Turks head set of rolls 28 to take out camber and through a set of pulling rolls 29 which eject the sheath, ready for further processing preparatory for the spiralling operation.

The roll sets 25 and 26 are adjustable to vary the bight therebetween and stepper motors 30,31 are connected to the bearings of a roll in each set to effect movement of such roll toward and away from its companion roll. Operation of the motors is ultimately effected by the signal generated by the difference in rotation of the measuring rolls 11 and 19.

Figure 2:
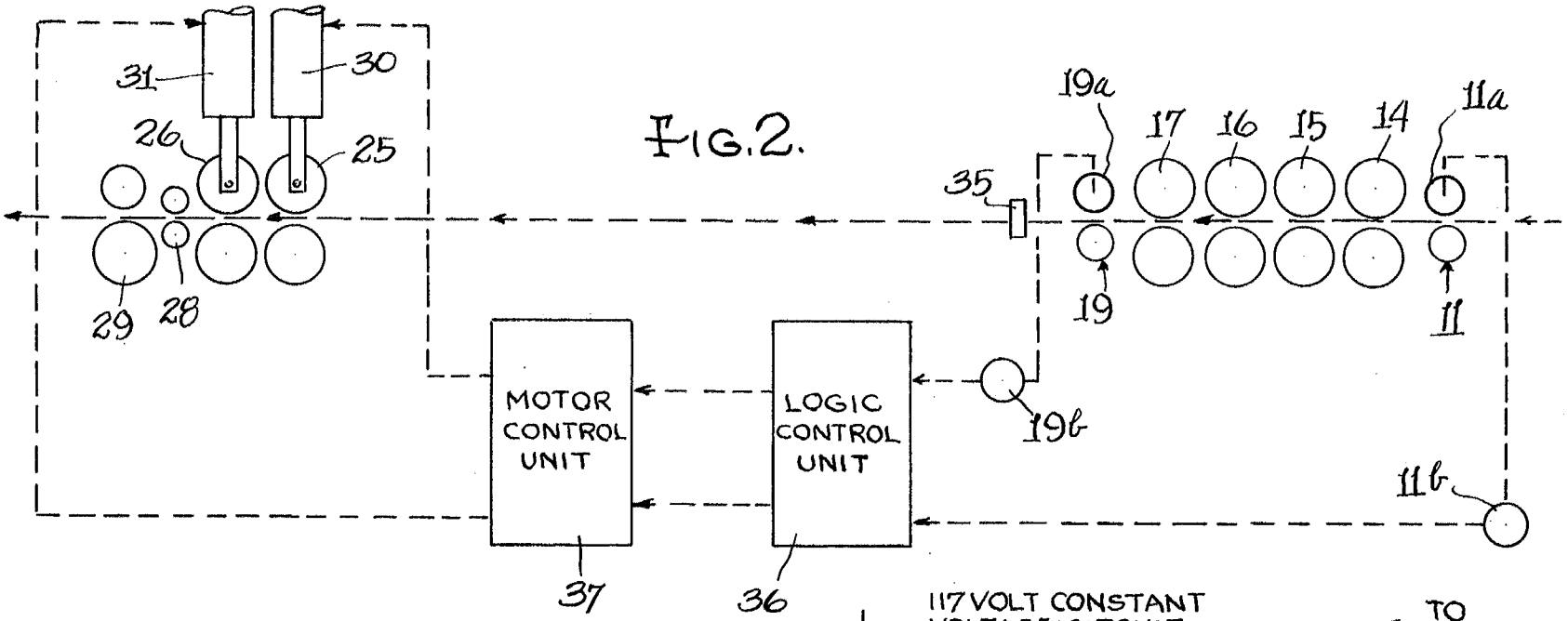
FIG. 2 is a generally schematic view of parts shown in FIG. 1, and including a circuit diagram of associated components.
Figure 4:
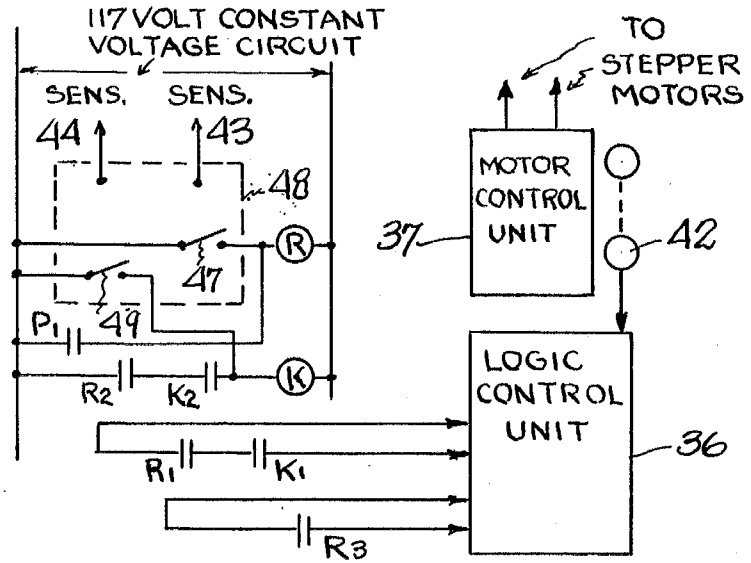
FIG. 4 is a circuit diagram for use in the embodiment of FIG. 3.

In the preferred embodiment, and with reference to FIG. 2, the measuring roll sets 11 and 19 have rolls **11*a*,19*a*, respectively, which are gravity actuated to frictionally engage the sheath. The rolls 11*a*,19*a* are of the same diameter and preferably have a urethane periphery for good wear quality and gripping engagement with the sheath. Each roll 11*a*,19*a* is connected in direct driving relation to the drive shaft of a pulse generator 11*b*,19*b*** each of which may be of the type manufactured by the Dynapar Corporation and designated as Type 82 Rotopulser. This type of pulse generator is a general purpose rotary transducer used for generating two quadrature square waves proportional to shaft rotation, and is suitable for applications that require a bidirectional incremental encoder that will operate over a wide range of shaft speeds, including low and zero speed. The electrical output of these pulse generators is suitable for interfacing with most logic systems. The rotopulsers, for example, provide 300 counts per revolution and require an input voltage 4.5 to 15 volts filtered DC.

The pulse generators are electrically connected so that both are switched "on" and "off" simultaneously. The leading end of the heating element being rolled will activate a proximity switch 35 (see FIG. 2) to switch to "on" both pulse generators, and these generators are automatically switched to "off" when the generator **11*a*** reaches a preset or predetermined number of pulses.

The roll **11*a* measures a sample of the starting length of the sheath and the roll 19*a* measures a sample of the growth of the sheath, and each roll causes corresponding rotation of its pulse generator. The output signal from pulse generator 19*b* is fed into a logic control unit 36 which may be of a type manufactured by the Dynapar Corporation. The unit 36 automatically compares by subtraction the output of pulse generator 19*b* from a length growth preset and, after making a series of computations, feeds a signal, plus or minus, to a motor control unit 37 which may also be of a type manufactured by the Dynapar Corporation. The unit 37 translates the signals from the unit 36 to pulses in a clockwise or counterclockwise direction, depending upon the plus or minus signal from the unit 36, and the pulses from unit 37 are transferred to the stepper motors 30,31**.

The motors may be standard stepper motors manufactured by the Superior Electric Company, and designated Slo-Syn Series, M092-F608-E. Each stepper motor 30,31 comprises a pair of motors connected to a respective upper roll of the sets of correction rolls 25,26 to move such upper roll toward or away from its companion roll. All four motors receive an identical signal from the motor control unit and all motors rotate in equal amounts and in a direction dependent upon the positive or negative numerical value of the signal. The signal value is the result of the computation within the logic unit 36 and the element's growth value input to the latter. Each step or indexing of the motor shafts results in 0.00025 inch (0.00645 millimeters) of upward or downward motion of the top correction roll, depending upon whether the signal to the motor has a positive or negative value. Each increment of squeeze results in an increment of sheath growth so therefore setting of the machine to control length is essentially one of correlating the amount of stepper motion with the amount of predicted growth.

It will be appreciated that the apparatus above described measures only a predetermined amount of sheath length (approximately 55% or less of its final length) extending inwardly from the leading end of the sheath, and this amount is controlled by setting the pulse generator **11*b* to terminate pulsing of both generators 11*b* and 19*b* after the generator 11*b* has reached a preset number of pulses. Since the remainder of the sheath passing through the reducing rolls 14–17 will grow a proportional amount, with allowance of an increment of error, the logic control unit 36 may be set to automatically send the proper signals to the motor control unit, which in turn sends the proper signals to the stepper motors 30,31**.

As an example of the method of length control, it will be assumed that the final target length to be maintained of a completely rolled tube is 61.569 inches (about 156 centimeters) and the start or unrolled length of the sheath is 56.00 inches (about 142.24 centimeters). Assume further that the measured length (the length which passes through the measuring roll set 11 of pulse generator **11*b*) is 28.00 inches (about 71.12 centimeters) and the growth length (the length which passes through the measuring roll set 19 of pulse generator 19*b*) is 30.24 inches (about 77 centimeters), and that the final uncorrected length of the fully-rolled sheath is 60.48 inches (about 153 centimeters). This would show that the sheath will have to be compressed by the working rolls 25,26** an amount to increase its length an amount of 1.089 inches (about 2.77 centimeters).

Therefore, it is necessary to adjust the logic control 36 unit to automatically feed signals to the motor control unit 37 to make required adjustment of the correction rolls 30,31. It is known that the rate of growth increases as the correction rolls approach maximum squeeze because there is more resistance to compression and since the material must go somewhere, it goes lengthwise at an increased rate.

According to known factors, reached through experiment, each downward incremental adjustment of the rolls results in an average sheath growth of approximately 0.018 inches (about 0.457 millimeters) per inch of element entering the correction rolls. In reality, the length growth per increment of squeeze is not proportional or a straight line progression. At high squeeze length growth is greater than 0.018 inches, and at less squeeze the value is less. The curve takes a general shape of a parabola. The logic control unit 36 is designed to function according to the following equation:

$$\text{Roll position} = \frac{\text{(Growth preset)} - \text{(sample length as measured by pulser 19b)}}{\text{Increment of error per step}}$$

Although hereinafter, inches or decimal equivalents will be used for growth preset and sample length measurements since it is easier to illustrate, these values in the logic control 36 are actually represented as digits reflected by the number of pulses generated by the Rotopulsers and the readout on a control panel (not shown) will show pulses, not inches, although, of course the pulses may be converted to inches, if desired.

With growth preset established at 30.42 inches (about 77 centimeters) and increment of error per step set at a value of 0.01 inches (about 0.254 millimeters) the necessary constants will be established for proper length control.

Using the element described above (which has a measured portion of 30.24 inches after preliminary rolling) the roll position of the correcting rolls 25,26 will be determined by the following formula:

$$\text{Roll position} = \frac{\text{(Growth preset)} - \text{(preliminary roll measurement by pulser 19b)}}{\text{Increment of error per step}}$$

or $$\text{Roll position} = \frac{30.42 - 30.24}{0.01} = 18$$

Correction rolls would be actuated such that at (18) the roll position would yield 0.018 inches per inch of element coming to the correction rolls. Thus, the rolled length of the sheath of 60.48 inches without correction, plus the corrected length of 1.089 inches will equal 61.569 inches, which is the final target length.

DESCRIPTION OF OTHER EMBODIMENT

Figure 3:
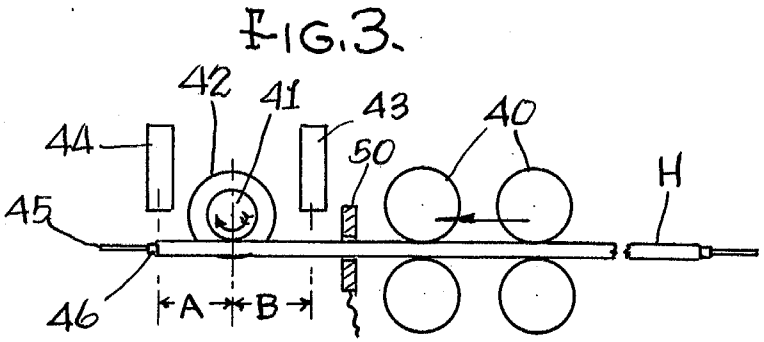
FIG. 3 is a generally schematic view of another embodiment of my invention.

With reference to FIG. 3, the heating element H is passed between the gaps of a plurality of reducing rolls 40 for the purpose of reducing the diameter of the sheath, and thus resulting in an elongation of the latter. A urethane-covered roll 41 rides on the outer surface of the sheath and is rotated by the linear movement of the sheath. The roll 41 is secured to the shaft of a pulse generator 42 (such as the Rotopulser hereinbefore referred to) to rotate the same.

Two color-sensing units 43,44 are disposed on opposite sides of the urethane roll and these may be type DL-TL10-08, manufactured by R. B. Denison Company. The sensors are intended to sense the dark color of the sheath and activate switching contacts, but remain inactive by the lighter shades of color of the terminal pin 45 or bushing 46.

As the heating element exits from the reduction rolls 40, the leading end of the switch activates a proximity sensor so as to cause closing of the sensor's contacts P1 and thereby energize relay R which closes contacts R1,R2 and R3. The element continues to move to the sensing unit 43 and activates the same, and this in turn closes contact 47 in an amplifier 48, which may be of type KL-KL8-01, manufactured by R. B. Denison Company. As the heating element continues its linear motion, the leading end thereof moves adjacent to the sensing unit 44 and activates the same, and this in turn closes switch contacts 49 to energize relay K, to in turn close contacts K1 and K2.

With both contacts 47,49 closed and R1 and R2 closed, the pulse generator 42 is gated in to generate pulses, with each pulse representing an increment of element length. The pulse generator continues pulsing until the trailing end of the heating element moves past the proximity sensor 50 to open contact P1 and then past color sensor 43 to open switch contacts 47 to halt pulsing of the generator 42. The purpose of relay R is to close contacts R3 which resets the measuring phase of the cycle for a new measurement and, when deenergized, gates into a logic circuit the number of pulses generated by the pulser 42. The prime function of relay K is to lock in the pulsing circuit the instant sensor 44 closes contacts 49. This is desired to keep sensors from stopping the counting in the event of false sensing, such as might result from a light colored code ring painted on the sheath.

The length of the sheath exiting from the reduction rolls 40 is equal to the distance "A"+"B"+"CF"+("No. P" times "IL"). Distance "A" plus "B" is the distance the sheath travels before the pulse generator is activated by both sensing units 43,44. "CF" is a correction factor constant which takes into consideration lost distance due to signal response time. "No. P" represents the number of pulses of the generator during the time it is gated in electrically. "IL" is the increment of length of the heating element per pulse.

The part of the formula above, namely A+B+CF is a constant which will be the same for all elements, and the only variable of interest is the number of pulses a specific element produces. Thus, a length growth preset is set by an operator on a logic control unit (such as the unit 36). This value is set higher (approximately 25 pulses higher) than the average number of pulses to be measured by the pulser 42. The logic control unit is sent the pulser value and subtracts this from the growth preset value. A signal in correspondence to the subtracted value is fed to a motor control unit (such as the unit 37) to correspondingly activate the stepper motors to further roll the sheath an amount to provide an elongation sufficient to bring the sheath to the final target length, within acceptable tolerances of plus or minus 3/16 inches.

The single-measuring roll concept shown in FIG. 3 has an advantage over the double-measuring roll concept of FIGS. 1 and 2 in that the full growth is measured and more precise length control is effected. Also it takes in account starting length variation. In the double-measuring roll concept only sample length (about 15% to 55% of the length of the element) is measured, and inaccuracies may result since an element may grow at different rates at different points along its length. However, with the single-measuring roll concept, a much longer machine is required for the longer elements. On the other hand, the two-roll concept is not particularly adaptable in the processing of shorter elements.

I claim:

1. Apparatus for rolling a rectilinear metal-sheathed electric heating element to a final target length, comprising:

a first set of reduction rolls for reducing the cross section of said sheath an amount less than the amount at final target length, a pair of measuring devices at longitudinally-spaced places along the movement of said sheath through said apparatus, one measuring device cooperable with an unrolled portion of said sheat as it passes through said apparatus and another measuring device cooperable with a rolled portion of said sheath as it passes through said apparatus, said other device providing a signal indicative of an increase in sheath length as a result of rolling by said first set of reduction rolls.

a further set of reduction rolls downstream of said measuring devices, and means actuated by said signal to adjust the bight of said further set of reduction rolls, so as to further reduce the cross section of said sheath to equal that at said final target length and thereby increase sheath length to said final target length within acceptable tolerances.

2. The apparatus according to claim 1 wherein said one measuring device is cooperable with said sheath prior to the latter's entry in said first set of reduction rolls, and said other measuring device is cooperable with said sheath following rolling in said first set of reduction rolls.

3. Apparatus for rolling a rectilinear metal-sheathed electric heating element to a final target length, comprising:

a first set of reduction rolls for reducing the cross section of said sheath an amount less than the amount at final target length, a second set of reduction rolls for further reducing the cross section of said sheath, the bight between this set of rolls being adjusted by stepper motors, measuring means actuated by movement of said sheath as it moves through said apparatus and adopted to provide an electrical signal indicative of an increase in sheath length as a result of rolling in said first set of rolls, a logic control unit receiving said electrical signal and comparing said signal with a preset reference signal and to make a resulting computation signal, a motor control unit receiving said computation signal and translating the same to an adjustment signal for said stepper motors to thereby adjust the bight between said second set of reduction rolls to cause further reduction of said sheath to equal that at final target length and thereby to increase sheath length to said final target length within acceptable tolerances.

4. The apparatus according to claim 3 wherein said measuring means comprises two pulse generators operable to measure the increase in sheath length in only a portion of the entire length of the sheath rolled in said first set of reduction rolls.

5. The apparatus according to claim 3 wherein said measuring means comprises a single pulse generator operable to measure the increase in sheath length in the full length of the sheath rolled in said first set of reduction rolls.

6. Apparatus for rolling a rectilinear metal-sheathed electric heating element to a final target length, comprising:

a first set of reduction rolls for reducing the cross section of said sheath an amount less than the amount at final target length, a second set of reduction rolls for further reducing the cross section of said sheath, a pulse generator having a roll in engagement with the exterior surface of said sheath as the latter leaves said first set of rolls, said roll being rotated by rectilinear movement of said sheath to cause said generator to generate electrical pulses corresponding to the sheath length rotating said roll, a pair of color-sensing units affected by the color of said sheath, one between said first set of rolls and said pulse generator and the other one on the opposite side of said pulse generator, said color-sensing units being in an electrical circuit and adapted to close contacts to gate in said pulse generator to generate pulses representing increments of sheath length as rolled in said first set of rolls, and means actuated by the pulses generated by said pulse generator to adjust the bight of said second set of rolls to further reduce the cross section of said sheath to an amount equal to that at final target length and thereby increase sheath length to said final target length within acceptable tolerances.

7. The apparatus according to claim 6 wherein the bight between said second set of rolls is adjusted by stepper motors, and wherein said means actuated by the pulses generated by said pulse generator comprises a logic control unit which receives said pulses and is adapted to compare the same with a preset reference value and make a resulting computation signal, and a motor control unit receiving said computation signal and translating the same to an adjustment for said stepper motors.

8. The method of rolling a rectilinear metal-sheathed electric heating element to a final target length, comprising:

reducing the cross section of said sheath in a first set of reduction rolls in an amount less than the amount at said final target length, measuring the increase in sheath length of only a portion of the full length of said sheath as rolled in said first set of rolls, translating the increase in sheath length to a signal representative of such increase, further reducing the cross section of said sheath in a second set of reduction rolls, and utilizing said signal to adjust the bight of said second set of rolls to an amount whereby said sheath is rolled to a cross section equal to that at said target length.

9. The method of rolling a rectilinear metal-sheathed electric heating element to a final target length, comprising:

reducing the cross section of said sheath in a first set of reduction rolls in an amount less than the amount at said final target length, holding a rotatable roll of a pulse generator in engagment with the exterior surface of the rectilinearly moving sheath to generate pulses corresponding to the sheath length rotating said roll, feeding said generated pulses to a logic control unit which compares the same with a preset reference value and makes a resulting computation signal, feeding said computation signal to a motor control unit which translates the same to an adjustment signal, feeding said adjustment signal to stepper motors which control the bight of said second set of reduction rolls to adjust said bight to an amount wherein the cross section of said sheath is further reduced to an amount equal to that at said final target length, and rolling said sheath in the adjusted second set of rolls.

* * * * *